US006089535A

United States Patent [19]

Mizutani et al.

[11] Patent Number: 6,089,535

[45] Date of Patent: Jul. 18, 2000

[54] THROTTLE VALVE CONTROL DEVICE

[75] Inventors: Koichi Mizutani; Masumi Nagasaka; Takashi Yamaguchi, all of Toyota; Takamasa Kitamura, Nagoya; Masato Seki, Obu; Satoru Matsumoto, Toyota; Kenji Takine, Akashi, all of Japan

[73] Assignees: Toyota Jidosha Kabushiki Kaisha, Toyota; Fujitsu Ten Limited, Kobe, both of Japan

[21] Appl. No.: 08/991,253

[22] Filed: Dec. 16, 1997

[30] Foreign Application Priority Data

Dec. 19, 1996 [JP] Japan ..... 8-340171

[51] Int. Cl.[7] ..... F02D 41/22

[52] U.S. Cl. ..... 251/129.04; 123/361; 123/399

[58] Field of Search ..... 251/129.04, 129.11; 123/399, 361

[56] References Cited

U.S. PATENT DOCUMENTS

| | | | |
|---|---|---|---|
| 4,915,074 | 4/1990 | Arai | 251/129.11 X |
| 5,669,353 | 9/1997 | Shirai et al. | 123/399 |
| 5,823,164 | 10/1998 | Seki et al. | 123/399 X |
| 5,983,860 | 11/1999 | Kitamura et al. | 123/399 |

FOREIGN PATENT DOCUMENTS

| | | |
|---|---|---|
| 4-214949 | 8/1992 | Japan . |
| 4-505495 | 9/1992 | Japan . |
| 6-332527 | 12/1994 | Japan . |
| 7-34912 | 2/1995 | Japan . |
| 8-158900 | 6/1996 | Japan . |

*Primary Examiner*—Kevin Lee
*Attorney, Agent, or Firm*—Oliff & Berridge, PLC

[57] ABSTRACT

The throttle valve control device of this invention controls a throttle based on outputs of a position sensor including a first sensor and a second sensor which detect a position of a same object, wherein the output of the first sensor and the output of the second sensor change opposite to each other depending on a change in the position of the object, and the throttle valve control device determines the position sensor abnormal when a variation in the output of the first sensor is equal to or greater than a first threshold value and a variation in the output of the second sensor is equal to or greater than a second threshold value.

6 Claims, 8 Drawing Sheets

THROTTLE VALVE CONTROL DEVICE

BACKGROUND OF THE INVENTION

1. Field of the Invention

The present invention relates to a throttle valve control device which detects an abnormality of a double-system sensor including a main sensor and a sub-sensor having characteristics with the opposite polarities.

2. Description of the Related Art

Japanese Laid-Open Publication No. 4-214949 discloses using two potentiometers which have characteristics with the opposite polarities as an opening angle sensor. The Publication discloses a device which can detect a disconnection or a short circuit occurring in each of the two potentiometers as an abnormality of the opening angle sensor.

However, the Publication has not considered the case of a short circuit occurring between output terminals of the two potentiometers.

A short circuit between output terminals of a double-system sensor may occur on a route between wire harnesses or inside a component. When such a short circuit occurs, the output voltage of the double-system sensor abruptly changes in a large amount. This large abrupt change may greatly affect the throttle valve control.

In view of the foregoing, the objective of the present invention is to provide a throttle valve control device which can properly detect a short circuit between output terminals of a double-system sensor.

SUMMARY OF THE INVENTION

The throttle valve control device of this invention controls a throttle based on outputs of a position sensor including a first sensor and a second sensor which detect a position of a same object, wherein the output from the first sensor and the output from the second sensor change opposite to each other depending on a change in the position of the object, and the throttle valve control device determines the position sensor abnormal when a variation in the output of the first sensor is equal to or greater than a first threshold value and a variation in the output of the second sensor is equal to or greater than a second threshold value.

In one embodiment of the invention, the throttle valve control device determines the position sensor abnormal when the output of the first sensor and the output of the second sensor are close to outputs of the first sensor and the second sensor to be obtained after an output terminal of the first sensor and an output terminal of the second sensor are short-circuited and a brake is also being operated.

Alternatively, the throttle valve control device of this invention controls a throttle based on outputs from a position sensor including a first sensor and a second sensor which detect a position of a same object, wherein the output from the first sensor and the output from the second sensor change opposite to each other depending on a change in the position of the object, and the throttle valve control device determines the position sensor abnormal when the output of the first sensor and the output of the second sensor become substantially the same within a predetermined time period after a variation in the output of the first sensor becomes equal to or greater than a first threshold value and a variation in the output of the second sensor becomes equal to or greater than a second threshold value.

Alternatively, the throttle valve control device of this invention controls a throttle based on outputs from a position sensor including a first sensor and a second sensor which detect a position of a same object, wherein the output from the first sensor and the output from the second sensor change opposite to each other depending on a change in the position of the object, and a current flowing through the position sensor from a power source is detected, and the throttle valve control device determines the position sensor abnormal when the current is equal to or greater than a predetermined threshold value.

Alternatively, the throttle valve control device of this invention controls a throttle based on outputs from a position sensor including a first sensor and a second sensor which detect a position of a same object, wherein the output from the first sensor and the output from the second sensor change opposite to each other depending on a change in the position of the object, and a voltage is supplied from a constant voltage source to the position sensor via a resistor, and the throttle valve control device determines the position sensor abnormal when the voltage at a point downstream of the resistor is not equal to a predetermined value.

Alternatively, the throttle valve control device of this invention controls a throttle based on outputs from a position sensor including a first sensor and a second sensor which detect a position of a same object, wherein the output from the first sensor and the output from the second sensor change opposite to each other depending on a change in the position of the object, and a resistance between an output terminal of the first sensor and an output terminal of the second sensor is detected, and the throttle valve control device determines the position sensor abnormal when the resistance is equal to or less than a predetermined value.

Alternatively, the throttle valve control device of this invention controls a throttle based on outputs of a position sensor including a first sensor and a second sensor which detect a position of a same object, wherein the throttle valve control device determines the position sensor abnormal when the output of the first sensor and the output of the second sensor are close to outputs of the first sensor and the second sensor to be obtained after an output terminal of the first sensor and an output terminal of the second sensor are short-circuited and a brake is also being operated.

Thus, according to the present invention, the position sensor is determined abnormal when the variation in the output of the first sensor is equal to or greater than a first threshold value and the variation in the output of the second sensor is equal to or greater than a second threshold value. This makes it possible to detect a short circuit between the output terminals of the first-and second sensors, because the outputs of the first and second sensors abruptly change at the occurrence of the short circuit.

According to the present invention, the position sensor is determined abnormal when the outputs of the first and second sensors are close to the outputs of the first and second sensors to be obtained after the output terminal of the first sensor and the output terminal of the second sensor are short-circuited and the brake is being operated. This makes it possible to detect a short circuit between the output terminals of the first and second sensors, even when the outputs of the first and second sensors are close to the outputs of the first and second sensors to be obtained after the output terminals of the first and second sensors are short-circuited, at the time of the short circuit between the output terminals of the first and second sensors.

According to the present invention, the position sensor is determined abnormal when the output of the first sensor and the output of the second sensor become substantially the same within a predetermined time period after the variation in the output of the first sensor becomes equal to or greater than a first threshold value and the variation in the output of the second sensor becomes equal to or greater than a second threshold value. This makes it possible to detect a short circuit between the output terminals of the first and second sensors, because the outputs of the first and second sensors abruptly change and then become substantially the same at the occurrence of the short circuit.

According to the present invention, a current flowing from a power source to the position sensor is detected, and the position sensor is determined abnormal when the current is equal to or greater than a predetermined threshold value. This makes it possible to detect a short circuit between the output terminals of the first and second sensors, because an excess current flows through the position sensor at the occurrence of the short circuit.

According to the present invention, a voltage is supplied from the constant voltage source to the position sensor via the resistor, and the position sensor is determined abnormal when the voltage at a point downstream of the resistor is not equal to a predetermined value. This makes it possible to detect a short circuit between the output terminals of the first and second sensors, because the voltage at a point downstream of the resistor varies, deviating from the predetermined value, at the occurrence of the short circuit.

According to the present invention, the resistance between the output terminal of the first sensor and the output terminal of the second sensor is detected, and the position sensor is Determined abnormal when the resistance is equal to or less than a predetermined value. This makes it possible to detect a short circuit between the output terminals of the first and second sensors, because the resistance between the output terminals of the first and second sensors becomes small at the occurrence of a short circuit.

Thus, the invention described herein makes possible the advantage of providing a throttle valve control device which can properly detect a short circuit between output terminals of a double-system sensor.

These and other advantages of the present invention will become apparent to those skilled in the art upon reading and understanding the following detailed description with reference to the accompanying figures.

DESCRIPTION OF THE PREFERRED EMBODIMENTS

Hereinbelow, the present invention will be described by way of examples with reference to the accompanying drawings.

EXAMPLE 1

Figure 1:
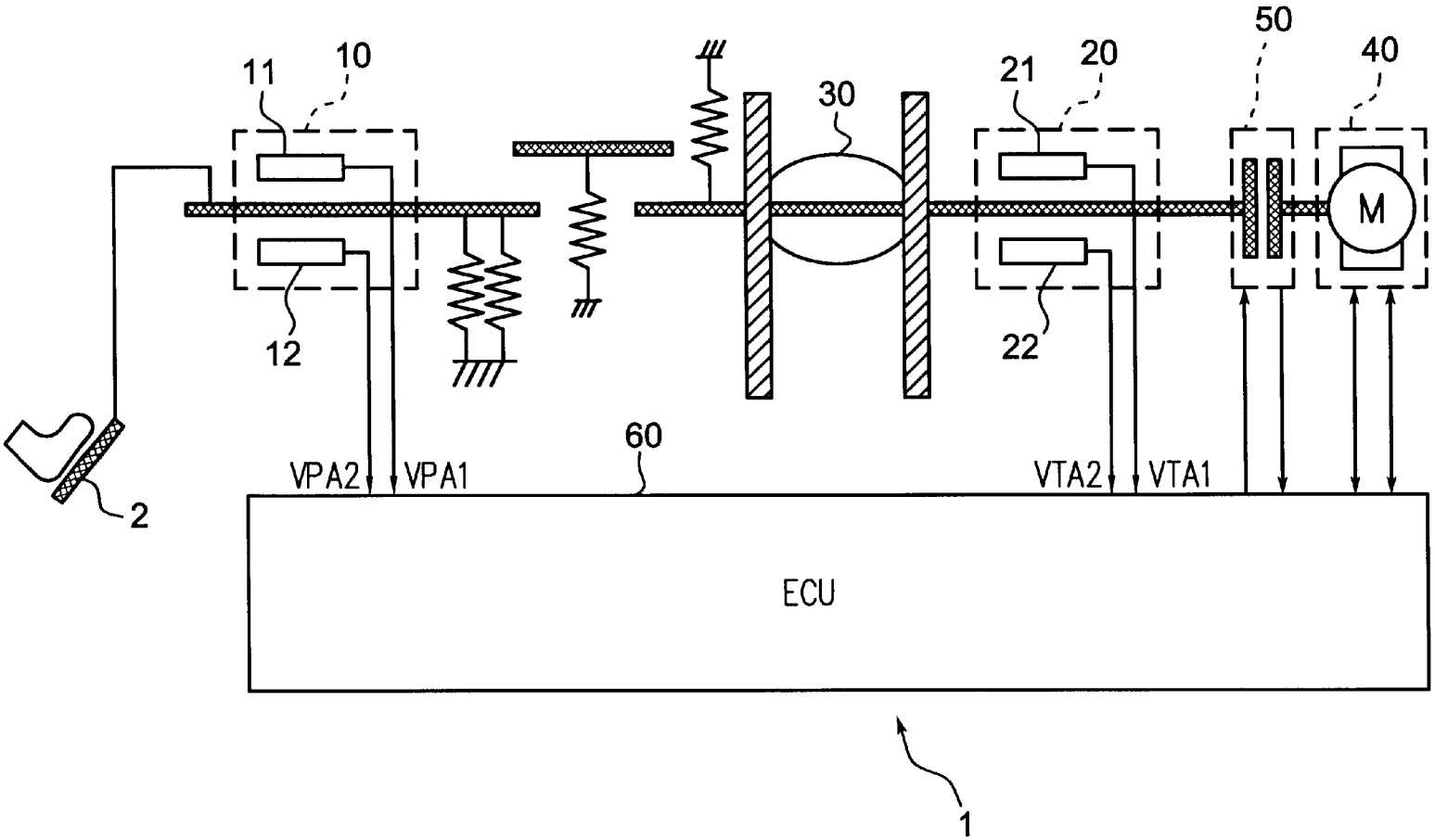
FIG. 1 is a structural view of a throttle valve control device according to the present invention.

FIG. 1 shows a throttle valve control device 1 of this example according to the present invention. The throttle valve control device 1 includes a double-system accelerator position sensor 10, a double-system throttle position sensor 20, a motor 40 for driving a throttle valve 30, an electromagnetic clutch 50 for controlling the connection/disconnection between the throttle valve 30 and the motor 40, and an electronic control unit (ECU) 60.

The accelerator position sensor 10 includes a main sensor 11 and a sub-sensor 12. The main sensor 11 detects the position of the accelerator based on the amount with which an accelerator pedal 2 is pressed, and outputs a detection signal VPA1 indicating the accelerator position to the ECU 60. The sub-sensor 12 also detects the accelerator position based on the amount with which the accelerator pedal 2 is pressed, and outputs a detection signal VPA2 indicating the accelerator position to the ECU 60.

The throttle position sensor 20 includes a main sensor 21 and a sub-sensor 22. The main sensor 21 detects the actual position of the throttle valve 30, and outputs a detection signal VTA1 indicating the actual position of the throttle valve 30. The sub-sensor 22 also detects the actual position of the throttle valve 30, and outputs a detection signal VTA2 indicating the actual position of the throttle valve 30.

The ECU 60 calculates a target opening of the throttle valve 30 based on the detection signals VPA1 and VPA2 output from the accelerator position sensor 10. The ECU 60 also controls the rotation of the motor 40 based on the detection signals VTA1 and VTA2 output from the throttle position sensor 20 so that the actual opening of the throttle valve 30 is closer to the target opening.

The ECU 60 controls the electromagnetic clutch 50 so that the throttle valve 30 and the motor 40 are electromagnetically connected to each other during the normal driving of a vehicle.

Figure 2:
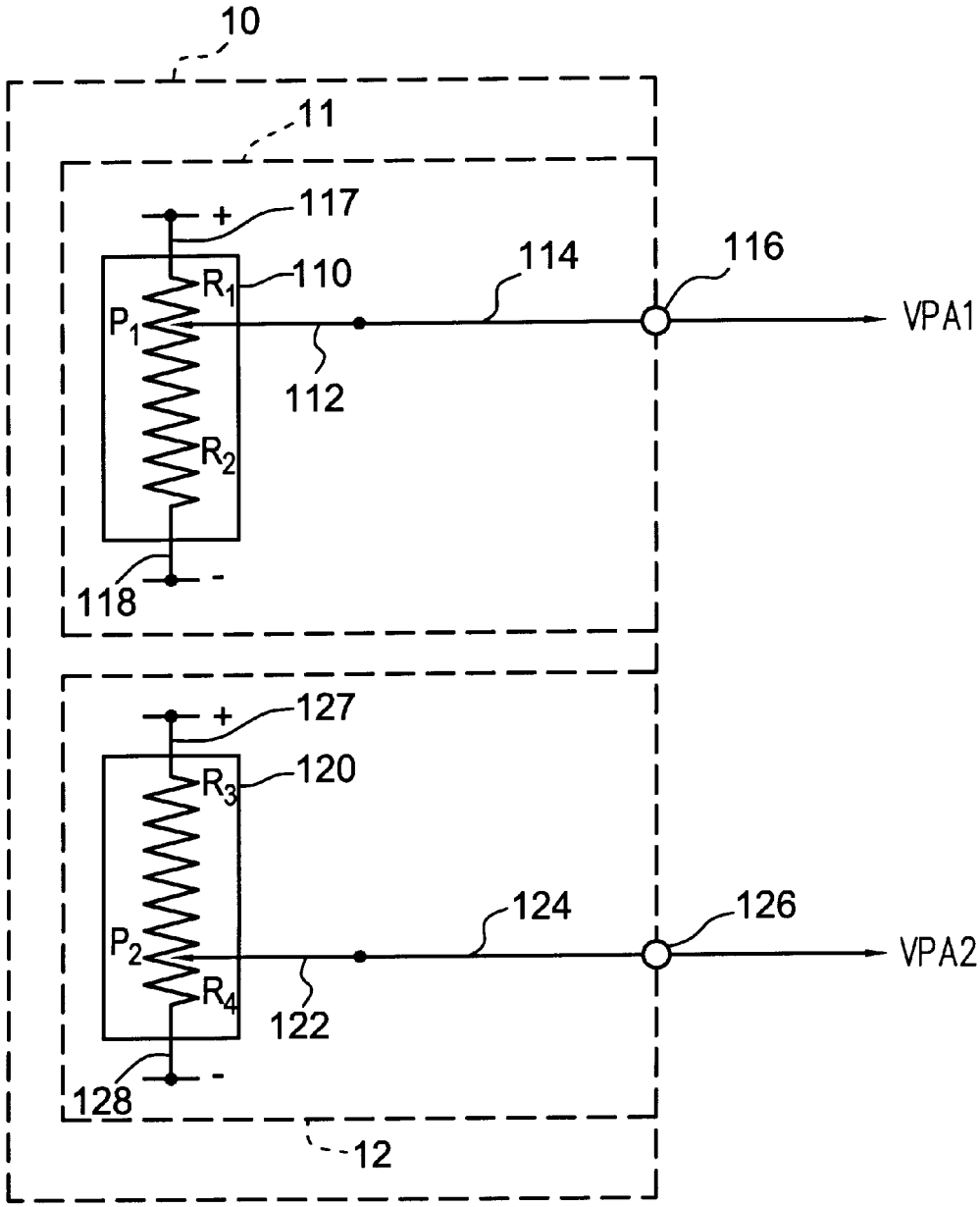
FIG. 2 is a structural view of an accelerator position sensor of the throttle valve control device of FIG. 1.

FIG. 2 is a structural view of the accelerator position sensor 10. The main sensor 11 outputs the output voltage VPA1 via an output terminal 116, and the sub-sensor 12 outputs the output voltage VPA2 via an output terminal 126. In FIG. 2, the main sensor 11 and the sub-sensor 12 are shown as double potentiometers.

A resistance surface 110 of the main sensor 11 is connected to the positive and negative polarities of a power voltage via a lead 117 and a lead 118, respectively. A slider 112 is provided to slide along the resistance surface 110 in accordance with the accelerator position, and is connected to the output terminal 116 via a lead 114.

Likewise, a resistance surface 120 of the sub-sensor 12 is connected to the positive and negative polarities of the power voltage via a lead 127 and a lead 128, respectively. A slider 122 is provided to slide along the resistance surface 120 in accordance with the accelerator position, and is connected to the output terminal 126 via a lead 124.

A contact point $P_1$ of the slider 112 with the resistance surface 110 divides the resistance at the resistance surface 110 into a resistance $R_1$ and a resistance $R_2$. Likewise, a contact point $P_2$ of the slider 122 with the resistance surface 120 divides the resistance at the resistance surface 120 into a resistance $R_3$ and a resistance $R_4$. The sliders 112 and 122 slide along the resistance surfaces 110 and 120, respectively, so as to satisfy the relationship, $R_2/R_1=R_3/R_4$. The sliders 112 and 122 are coupled with each other via a mechanical coupling member, for example.

Figure 3:
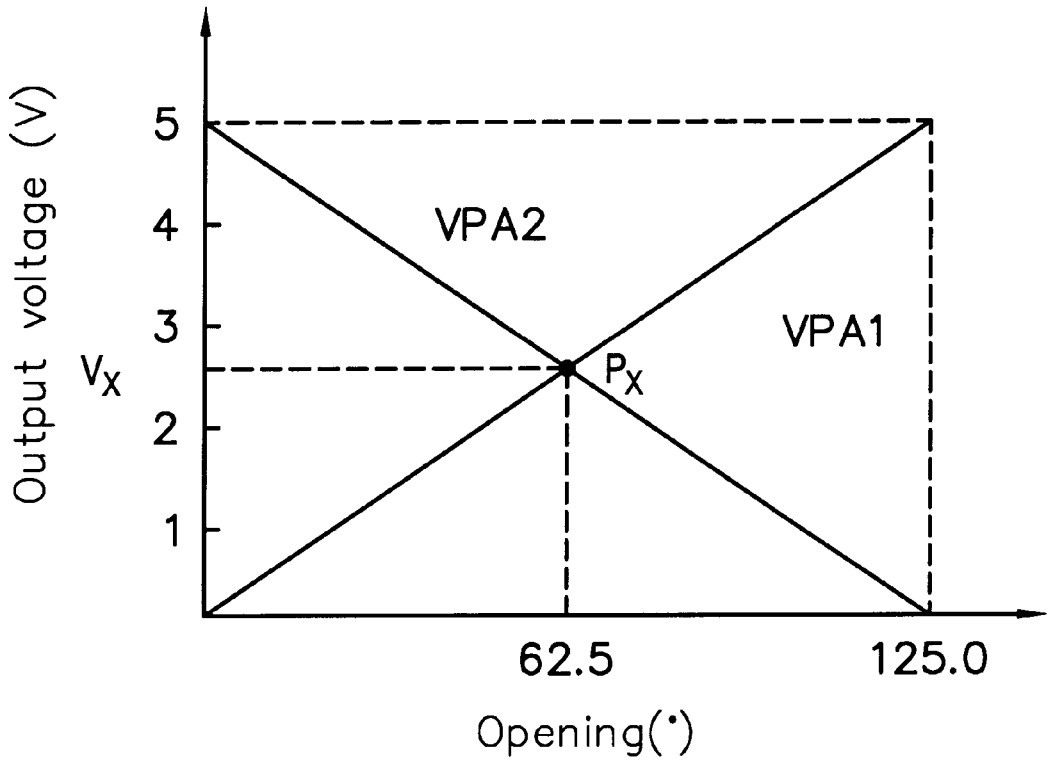
FIG. 3 is a graph showing the characteristics of output voltages of a main sensor and a sub-sensor of the accelerator position sensor of FIG. 2.

FIG. 3 shows the characteristics of the output voltage VPA1 of the main sensor 11 and the output voltage VPA2 of the sub-sensor 12. As is observed from FIG. 3, as the opening of the accelerator is larger, the output voltage VPA1 of the main sensor 11 increases, while the output voltage VPA2 of the sub-sensor 12 decreases. In this example shown in FIG. 3, the absolute values of the slopes of the straight lines representing the output voltage characteristics of the main sensor 11 and the sub-sensor 12 are equal to each other. The output voltage characteristics of the accelerator position sensor 10 are not limited to those shown in FIG. 3, but any output voltage characteristics may be used as far as the output voltages VPA1 and VPA2 vary opposite to each other depending on the change in the opening of the accelerator.

In the accelerator position sensor 10 having the above output voltage characteristics, when a short circuit occurs between the output terminal 116 of the main sensor 11 and the output terminal 126 of the sub-sensor 12, the output voltage VPA1 of the main sensor 11 and the output voltage VPA2 of the sub-sensor 12 become substantially the same. That is, the output voltages VPA1 and VPA2 become a voltage $V_x$ which corresponds to an intersection point $P_x$ between the straight line representing the output voltage characteristics of the main sensor 11 and the straight line representing the output voltage characteristics of the sub-sensor 12. In FIG. 3, the voltage $V_x$ is 2.5 V, for example.

In the case where the output voltages VPA1 and VPA2 are far from the voltage $V_x$ at the time when a short circuit occurs between the output terminal 116 of the main sensor 11 and the output terminal 126 of the sub-sensor 12, both the output voltages VPA1 and VPA2 abruptly change. By detecting such abrupt changes in the output voltages VPA1 and VPA2, the abnormality of the accelerator position sensor 10 can be detected.

On the other hand, in the case where the output voltages VPA1 and VPA2 are close to the voltage $V_x$ at the time when a short circuit occurs between the output terminal 116 of the main sensor 11 and the output terminal 126 of the sub-sensor 12, the changes in the output voltages VPA1 and VPA2 are small. It is therefore difficult to detect the abnormality of the accelerator position sensor 10 by detecting the changes in the output voltages VPA1 and VPA2. In this case, therefore, another parameter is required to detect the abnormality of the accelerator position sensor 10.

Hereinbelow, the ECU 60 which can detect a short circuit between the output terminal 116 of the main sensor 11 and the output terminal 126 of the sub-sensor 12 will be described with reference to FIG. 4.

The ECU 60 includes a central processing unit (CPU) 61, a read-only memory (ROM) 62, and a random access memory (RAM) 63. The CPU 61, the ROM 62, and the RAM 63 are connected with one another via a bus 64. The ECU 60 further includes filters 65 to 68, an analog/digital (A/D) converter 69, and a power circuit 55.

The output voltage VPA1 from the accelerator position sensor 10 is input into the CPU 61 via the filter 65 and the A/D converter 69. Likewise, the output voltage VPA2 from the accelerator position sensor 10 is input into the CPU 61 via the filter 66 and the A/D converter 69.

The output voltage VTA1 from the throttle position sensor 20 is input into the CPU 61 via the filter 67 and the A/D converter 69. Likewise, the output voltage VTA2 from the throttle position sensor 20 is input into the CPU 61 via the filter 68. and the A/D converter 69.

The power circuit 55 supplies a power voltage to the accelerator position sensor 10 and the throttle position sensor 20.

The ROM 62 stores a program for the abnormality detection process for the accelerator position sensor 10. The CPU 61 reads the program stored in the ROM 62 and executes the abnormality detection process.

Figure 5:
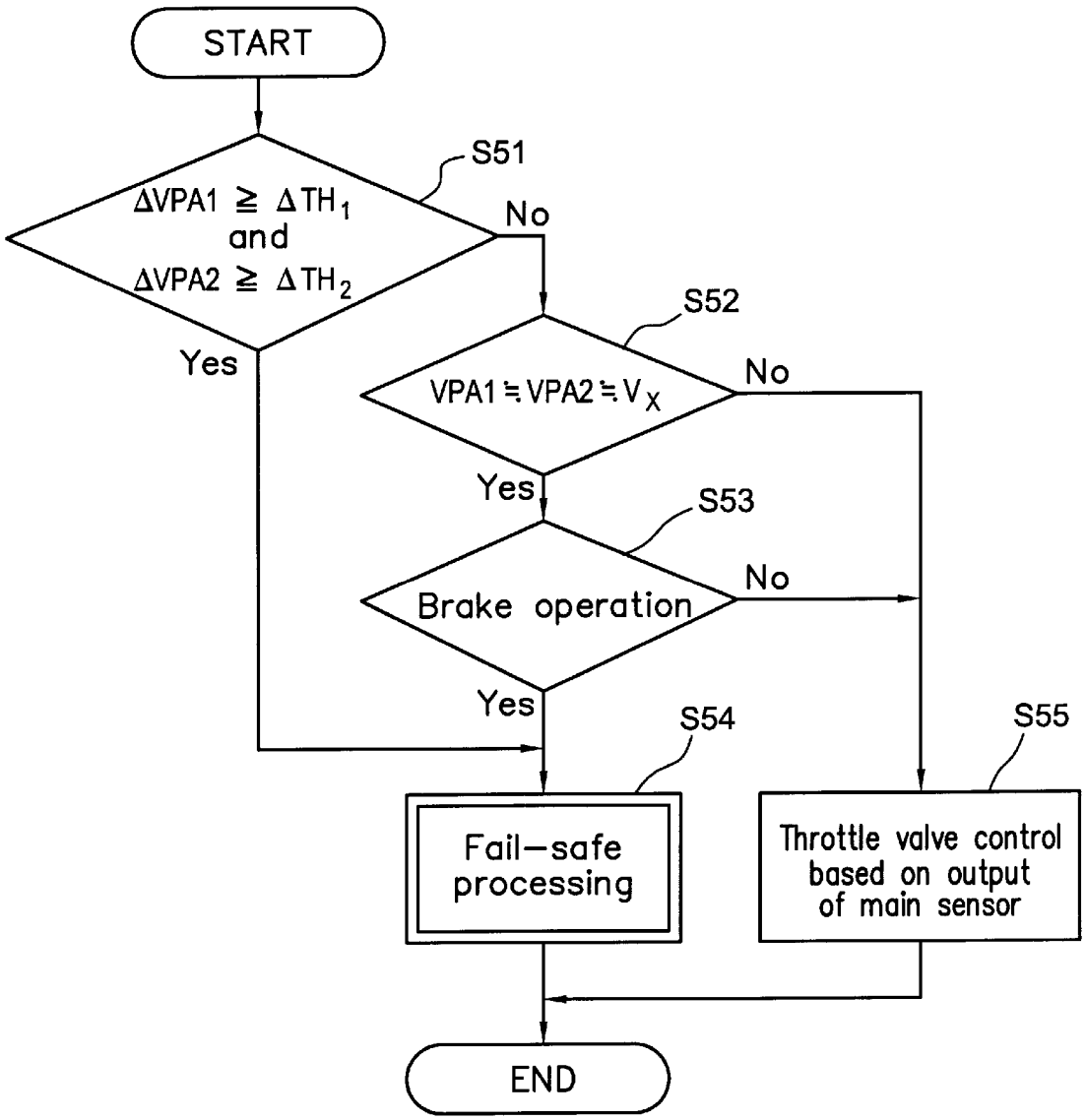
FIG. 5 is a flowchart showing an abnormality detection process by the accelerator position sensor of FIG. 2.

FIG. 5 shows the procedure of the abnormality detection process for the accelerator position sensor 10 which is executed by the CPU 61 every predetermined time period (e.g., every four msec). Hereinbelow, the abnormality detection process for the accelerator position sensor 10 will be described step by step.

At step S51, the CPU 61 determines whether or not a variation ΔVPA1 in the output voltage VPA1 of the main sensor 11 is equal to or greater than a predetermined threshold value $\Delta TH_1$ and a variation ΔVPA2 in the output voltage VPA2 of the sub-sensor 12 is equal to or greater than a predetermined threshold value $\Delta TH_2$. The variations ΔVPA1 and ΔVPA2 are obtained by differentiating the output voltages VPA1 and VPA2 by time, respectively. Each of the predetermined threshold values $\Delta TH_1$ and $\Delta TH_2$ is set at a value larger than the maximum of the output voltage obtained by pressing the accelerator pedal 2.

If the determination result at step S51 is "Yes", the accelerator position sensor 10 is determined abnormal, and the process proceeds to step S54.

At step S54, the CPU 61 executes a fail-safe processing, where the throttle valve control is discontinued once the accelerator position sensor 10 is determined abnormal.

The throttle valve control may be discontinued by various methods. For example, the CPU 61 discontinues the throttle valve control by turning off both the motor 40 and the electromagnetic clutch 50.

In this way, the electronic throttle valve control is discontinued in the case where the abnormality of the accelerator position sensor 10 is confirmed. As a precaution, therefore, it is preferable to provide a mechanism for controlling the throttle valve 30 in place of the electronic throttle valve control when such a case occurs, to ensure that the vehicle can be at least driven to a sidetrack. This emergency driving to a sidetrack is possible by mechanically linking the accelerator pedal 2 and the throttle valve 30 after the motor 40 and the electromagnetic clutch 50 are turned off.

If the determination result at step S51 is "No", the process proceeds to step S52.

At step S52, the CPU 61 determines whether or not the output voltages VPA1 and VPA2 are close to the voltage $V_x$ which is the voltage corresponding to the intersection point $P_x$ between the straight line representing the output voltage characteristics of the main sensor 11 and the straight line representing the output voltage characteristics of the sub-sensor 12, as described above.

If the determination result at step S52 is "No", the accelerator position sensor 10 is determined normal, and the throttle valve control based on the output voltage VPA1 of the main sensor 11 is performed at step S55. This follows the normal throttle valve control.

If the determination result at step S52 is "Yes", the process proceeds to step S53.

At step S53, the CPU 61 determines whether or not a brake of the vehicle is being operated. This can be determined by examining whether or not a stop lamp switch is on, for example. Alternatively, this may be determined by examining whether or not the variation in the output of a brake boost sensor, $\Delta V_{PBK}(=V_{PBK(n)}-V_{PBK(n-1)})$, is equal to or greater than a predetermined threshold value $\Delta VH_3$.

If the determination result at step S53 is "No", the accelerator position sensor 10 is determined normal, and the process proceeds to step S55. If "Yes", the accelerator position sensor 10 is determined abnormal, and the process proceeds to step S54.

Thus, if the output voltages VPA1 and VPA2 are close to the voltage $V_x$ at the time of a short circuit 30 between the output terminal 116 of the main sensor 11 and the output terminal 126 of the sub-sensor 12, the CPU 61 uses a parameter regarding the brake operation to determine whether or not the accelerator position sensor 10 is normal.

At step S51 above, instead of the above determination conditions, the CPU 61 may determine whether or not the output voltages VPA1 and VPA2 become substantially the same within a predetermined time period after the variation ΔVPAl in the output voltage VPA1 of the main sensor 11 becomes equal to or greater than the predetermined threshold value $\Delta TH_1$ and the variation ΔVPA2 in the output voltage VPA2 of the sub-sensor 12 becomes equal to or greater than the predetermined threshold value $\Delta TH_2$. This further ensures the detection of the short circuit between the output terminal 116 of the main sensor 11 and the output terminal 126 of the sub-sensor 12.

EXAMPLE 2

Figure 6:
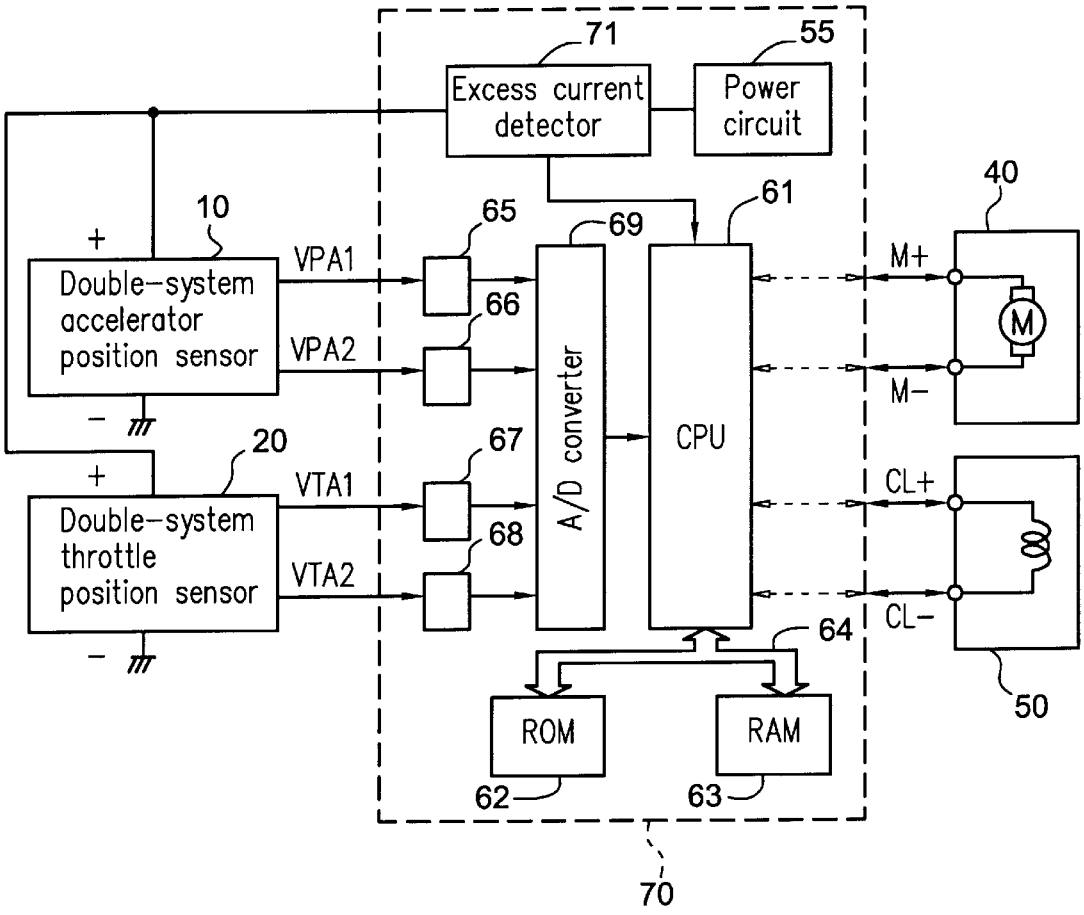
FIG. 6 is a structural view of an alternative example of the ECU according to the present invention.

In this example, the ECU 60 of the throttle valve control device shown in FIG. 1 is replaced with an ECU 70 shown in FIG. 6. The ECU 70 can detect a short circuit between the output terminal 116 of the main sensor 11 and the output terminal 126 of the sub-sensor 12 by detecting an excess current.

Figure 4:
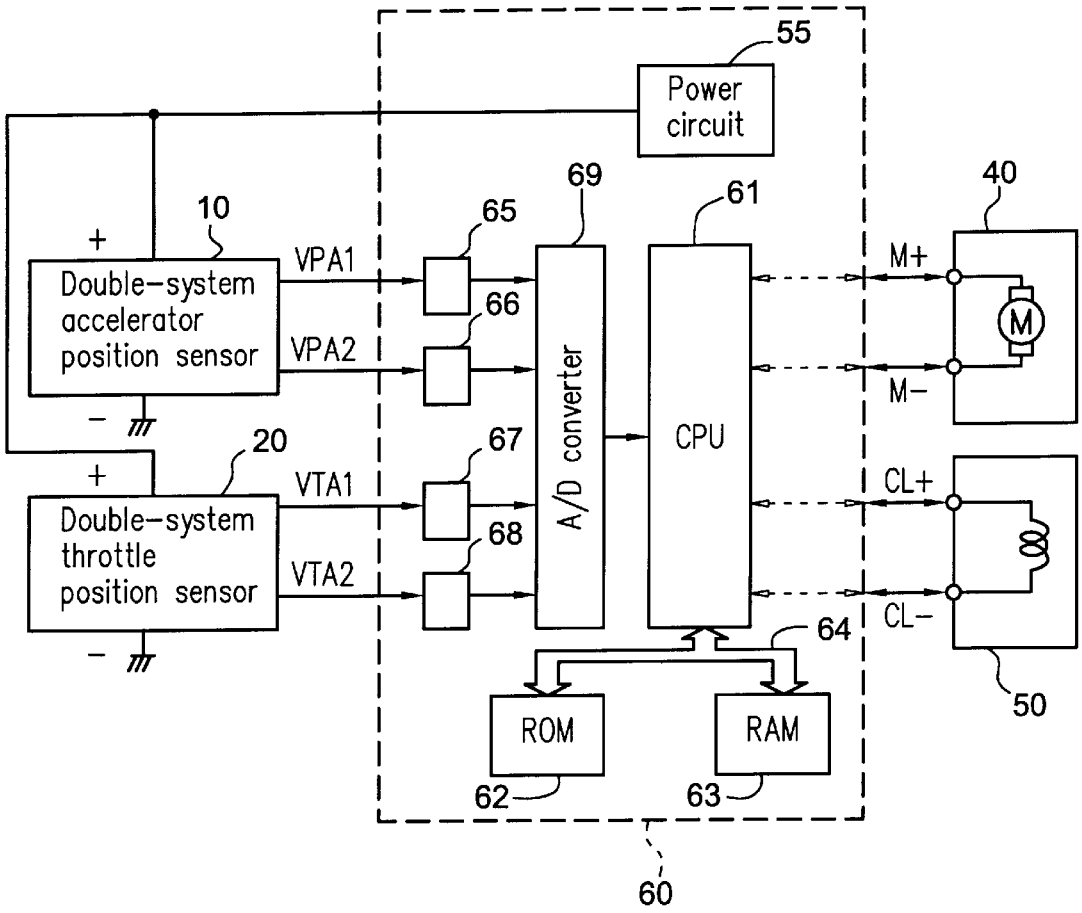
FIG. 4 is a structural view of an ECU of the throttle valve control device of FIG. 1.

Referring to FIG. 6, the configuration of the ECU 70 is the same as that of the ECU 60 shown in FIG. 4, except that an excess current detector 71 is additionally provided. The same components as those in FIG. 4 are denoted by the same reference numerals, and the description thereof is omitted here.

The excess current detector 71 detects a current flowing from the power circuit 55 to the accelerator position sensor 10. The excess current detector 71 may be a hall element type current sensor or a servo type DC current sensor, for example. Alternatively, the excess current detector 71 may include a photodiode which emits light in response to a current and a phototransistor which has a resistance variable depending on the light emitted from the photodiode, so as to detect a voltage variation at a point downstream of the phototransistor and thus to detect an excess current flowing through the photodiode.

The CPU 61 determines whether or not the current detected by the excess current detector 71 is equal to or greater than a predetermined threshold value. If the current detected by the excess current detector 71 is equal to or greater than the predetermined threshold value, the CPU 61 determines the accelerator position sensor 10 abnormal, and executes the fail-safe processing. The fail-safe processing used in this example is the same as that at step S54 in FIG. 5. Alternatively, instead of the fail-safe processing, the CPU 61 may presume the opening of the accelerator based on the level of the excess current and continue the throttle valve control based on the presumed opening of the accelerator.

Thus, the detection of a short circuit between the output terminal 116 of the main sensor 11 and the output terminal 126 of the sub-sensor 12 is possible by detecting an excess current from the power circuit 55 to the accelerator position sensor 10, because an excess current flows when the output terminal 116 of the main sensor 11 and the output terminal 126 of the sub-sensor 12 are short-circuited.

EXAMPLE 3

Figure 7:
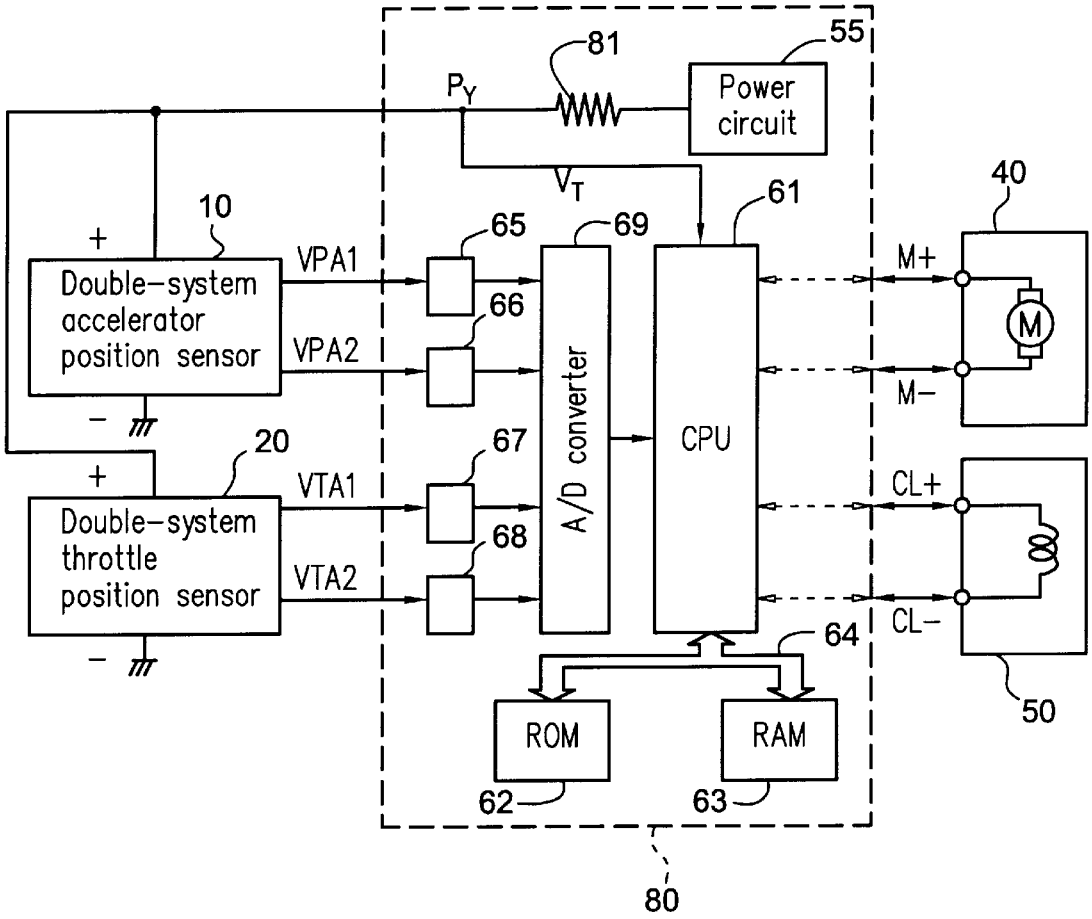
FIG. 7 is a structural view of another alternative example of the ECU according to the present invention.

In this example, the ECU 60 of the throttle valve control device shown in FIG. 1 is replaced with an ECU 80 shown in FIG. 7. The ECU 80 can detect a short circuit between the output terminal 116 of the main sensor 11 and the output terminal 126 of the sub-sensor 12 by detecting a voltage change.

Referring to FIG. 7, the configuration of the ECU 80 is the same as that of the ECU 60 shown in FIG. 4, except that a resistor 81 is additionally provided. The same components as those in FIG. 4 are denoted by the same reference numerals, and the description thereof is omitted here.

The resistor 81 is disposed between the power circuit 55 and the accelerator position sensor 10. The power circuit 55 supplies a constant voltage to the accelerator position sensor 10 via the resistor 81.

The CPU 61 determines whether or not a voltage $V_T$ at a point $P_T$ downstream of the resistor 81 is equal to a predetermined value. If the voltage $V_T$ is not equal to the predetermined value, the CPU 61 determines the accelerator position sensor 10 abnormal, and executes the fail-safe processing. The fail-safe processing used in this example is the same as that at step S54 in FIG. 5. Alternatively, instead of the fail-safe processing, the CPU 61 may presume the opening of the accelerator based on the level of the voltage $V_T$ and continue the throttle valve control based on the presumed opening of the accelerator.

Thus, the detection of a short circuit between the output terminal 116 of the main sensor 11 and the output terminal 126 of the sub-sensor 12 is possible by examining the voltage $V_T$ at the point $P_Y$ downstream of the resistor 81, because the voltage $V_T$ deviates from the predetermined value when the output terminal 116 of the main sensor 11 and the output terminal 126 of the sub-sensor 12 are short-circuited.

EXAMPLE 4

Figure 8:
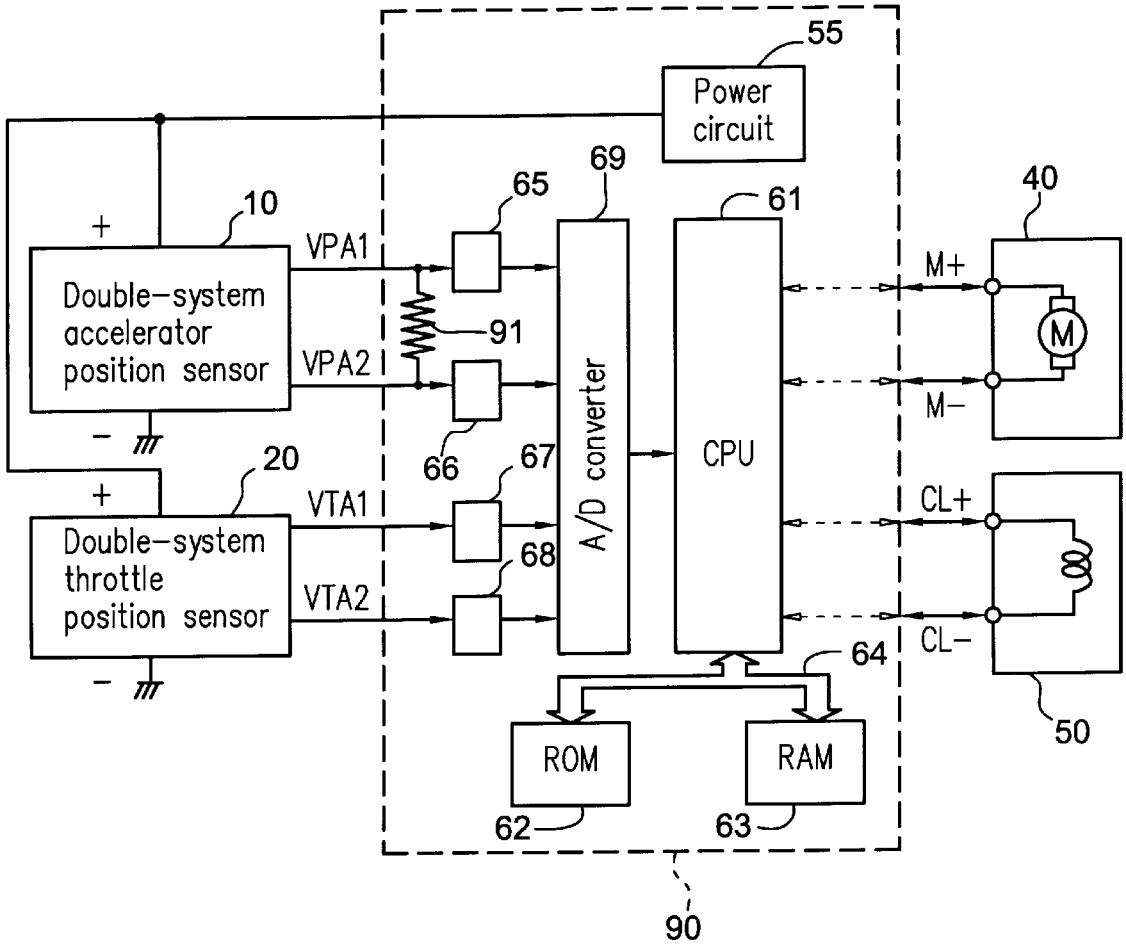
FIG. 8 is a structural view of still another alternative example of the ECU according to the present invention.

In this example, the ECU 60 of the throttle valve control device shown in FIG. 1 is replaced with an ECU 90 shown in FIG. 8. The ECU 90 can detect a short circuit between the output terminal 116 of the main sensor 11 and the output terminal 126 of the sub-sensor 12 by detecting a resistance change.

Referring to FIG. 8, the configuration of the ECU 90 is the same as that of the ECU 60 shown in FIG. 4, except that a resistor 91 is additionally provided. The same components as those in FIG. 4 are denoted by the same reference numerals, and the description thereof is omitted here.

The resistor 91 is disposed between the output terminal 116 of the main sensor 11 and the output terminal 126 of the sub-sensor 12. The resistor 91 has a very large resistance, as large as on the order of several mega ohms, for example.

The CPU 61 determines whether or not the resistance between the output terminal 116 of the main sensor 11 and the output terminal 126 of the sub-sensor 12 is equal to or less than a predetermined threshold value by detecting a minute current flowing through the resistor 91, for example. Alternatively, this determination may be performed by detecting a minute voltage drop at the resistor 91.

If the resistance between the output terminal 116 of the main sensor 11 and the output terminal 126 of the sub-sensor 12 is equal to or less than a predetermined threshold value, the CPU 61 determines the accelerator position sensor 10 abnormal, and executes the fail-safe processing. The fail-safe processing used in this example is the same as that at step S54 in FIG. 5.

Thus, the detection of a short circuit between the output terminal 116 of the main sensor 11 and the output terminal 126 of the sub-sensor 12 is possible by examining the resistance between the output terminal 116 of the main sensor 11 and the output terminal 126 of the sub-sensor 12, because the resistance decreases when the output terminal 116 of the main sensor 11 and the output terminal 126 of the sub-sensor 12 are short-circuited.

In Examples 1 to 4, the abnormality detection process for the accelerator position sensor 10 was described. The CPU 61 can also execute the abnormality detection process for the throttle position sensor 20 in a manner similar to that for the accelerator position sensor 10 described above.

The present invention is applicable to the detection of an abnormality of any double-system sensor which includes a main sensor and a sub-sensor having characteristics with the opposite polarities.

Thus, the throttle valve control device according to the present invention can detect a short circuit between the output terminal of the first sensor and the output terminal of the second sensor.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A throttle valve control device for controlling a throttle based on outputs of a position sensor including a first sensor and a second sensor which detect a position of a same object, wherein an output of the first sensor and an output of the second sensor change opposite to each other depending on a change in the position of the object, and the throttle valve control device determines the position sensor abnormal when a variation in the output of the first sensor is equal to or greater than a first threshold value and a variation in the output of the second sensor is equal to or greater than a second threshold value.

2. A throttle valve control device for controlling a throttle based on outputs of a position sensor including a first sensor and a second sensor which detect a position of a same object, wherein an output of the first sensor and an output of the second sensor change opposite to each other depending on a change in the position of the object, and the throttle valve control device determines the position sensor abnormal when the output of the first sensor and the output of the second sensor become substantially the same within a predetermined time period after a variation in the output of the first sensor becomes equal to or greater than a first threshold value and a variation in the output of the second sensor becomes equal to or greater than a second threshold value.

3. A throttle valve control device for controlling a throttle based on outputs of a position sensor including a first sensor and a second sensor which detect a position of a same object, wherein an output of the first sensor and an output of the second sensor change opposite to each other depending on a change in the position of the object, and a current flowing through the position sensor from a power source is detected, and the throttle valve control device determines the position sensor abnormal when the current is equal to or greater than a predetermined threshold value.

4. A throttle valve control device for controlling a throttle based on outputs of a position sensor including a first sensor and a second sensor which detect a position of a same object, wherein an output of the first sensor and an output of the second sensor change opposite to each other depending on a change in the position of the object, and a voltage is supplied from a constant voltage source to the position sensor via a resistor, and the throttle valve control device determines the position sensor abnormal when the voltage at a point downstream of the resistor is not equal to a predetermined value.

5. A throttle valve control device for controlling a throttle based on outputs of a position sensor including a first sensor and a second sensor which detect a position of a same object, wherein an output of the first sensor and an output of the second sensor change opposite to each other depending on a change in the position of the object, and a resistance between an output terminal of the first sensor and an output terminal of the second sensor is detected, and the throttle valve control device determines the position sensor abnormal when the resistance is equal to or less than a predetermined value.

6. A throttle valve control device for controlling a throttle based on outputs of a position sensor including a first sensor and a second sensor which detect a position of a same object, wherein an output of the first sensor and an output of the second sensor change opposite to each other depending on a change in the position of the object, wherein the throttle valve control device determines the position sensor abnormal when the output of the first sensor and the output of the second sensor are close to outputs of the first sensor and the second sensor to be obtained after an output terminal of the first sensor and an output terminal of the second sensor are short-circuited and a brake is also being operated.

* * * * *